US005634439A

United States Patent [19]

O'Brien

[11] Patent Number: 5,634,439

[45] Date of Patent: Jun. 3, 1997

[54] BIKE RIDER BALANCE BELT

[76] Inventor: Richard O'Brien, 175 Bergen Ave., Apt. 103, Ridgefield Park, N.J. 07660

[21] Appl. No.: 552,085

[22] Filed: Feb. 6, 1996

[51] Int. Cl.[6] ..... A63B 69/16; A62B 35/00

[52] U.S. Cl. ..... 119/770; 434/247

[58] Field of Search ..... 434/253, 255, 434/247; 604/179; 602/19; 128/876; 119/770, 725

[56] References Cited

U.S. PATENT DOCUMENTS

| | | | |
|---|---|---|---|
| D. 330,273 | 10/1992 | Cernek | 119/725 |
| 1,749,999 | 3/1930 | Crocker | 434/255 |
| 2,108,566 | 2/1938 | Sanders | 434/255 |
| 2,219,475 | 10/1940 | Flaherty | 602/19 |
| 2,275,983 | 3/1942 | Nadeau | 119/770 |
| 2,661,888 | 12/1953 | Sidlinger | 128/876 |
| 4,245,628 | 1/1981 | Eichler | 602/19 |
| 4,308,629 | 1/1982 | Freemon | 119/770 |
| 4,396,013 | 8/1983 | Hasslinger | 128/876 |
| 4,475,543 | 10/1984 | Brooks et al. | 602/19 |
| 4,666,017 | 5/1987 | Zimmerman | 119/770 |
| 4,836,194 | 6/1989 | Sebastian et al. | 602/19 |
| 4,981,110 | 1/1991 | Llewellyn | 119/770 |
| 5,074,795 | 12/1991 | Clark | 119/770 |
| 5,178,163 | 1/1993 | Yewer, Jr. | 128/876 |
| 5,316,022 | 5/1994 | Schiek, Sr. | 128/876 |
| 5,388,551 | 2/1995 | Martusciello | 119/770 |

FOREIGN PATENT DOCUMENTS

| | | | |
|---|---|---|---|
| 14541 | of 1893 | United Kingdom | 119/770 |

*Primary Examiner*—Paul J. Hirsch

*Attorney, Agent, or Firm*—Donald R. Heiner, Esq.

[57] ABSTRACT

A device to assist someone, such as a parent, in teaching a child to ride a bicycle. The device is a strap to be worn around the child's chest and extending around the back which can be fastened by way of velcro, buckles, or any other well-known fastening device. Two smaller or thinner straps are then attached to the main belt in the back which extend across the back of the belt and terminate in the middle in a ring or handle which can be grasped by the riding instructor. Such a device allows the teacher or instructor to hold the child itself rather then the bicycle and if the bicycle begins to fall it can be let go safely while holding onto the child.

5 Claims, 3 Drawing Sheets

BIKE RIDER BALANCE BELT

BACKGROUND OF INVENTION

1. Field of the Invention

The present invention generally involves the field of technology pertaining to a device to be worn by a child who is attempting to learn to ride a bicycle. The device essentially comprises a wide strap or belt which fastens, in any usual manner about the child and which extends around the back. Thinner or narrower straps are in turn attached to the main wide strap or belt and extend toward the middle of the back where they terminate in a ring or handle to be grasped by the person teaching the child to ride. This allows the teacher to stand erect and to not hold onto the bicycle but rather to hold onto the device and to let go of the bicycle and hold the child should the bicycle begin to fall.

In general, the Bike Rider Balance Belt comprises a device such as a strap or belt to be worn around the child's chest and fastened in the front by way of velcro, buckles, or any other well-known fastening device. Two smaller or thin straps are then attached to the main belt in the back and which extend across the back of the belt and terminate in the middle in a ring or handle.

In essence, the invention relates to a device worn by a novice bike rider whereby someone assisting the rider can hold on to the rider rather than the bicycle.

2. Description of the Prior Art

A search of the prior art has uncovered the following patents: U.S. Pat. No. 5,388,551 to Martusciello; U.S. Pat. No. 5,120,287 to Brown, et al.; U.S. Pat. No. 4,667,624 to Smith; U.S. Pat. No. 5,382,040 to Nanassi; U.S. Pat. No. 5,303,944 to Kalmus; U.S. Pat. No. 5,395,130 to Rubin; and, U.S. Pat. No. 5,217,240 to Gardenhour, Jr. et al.

The patent to Nanassi, U.S. Pat. No. 5,382,040 appears to be the most relevant reference uncovered. The aid in this patent allows the instructor to walk or run along side the cyclist while holding onto a rear-wardly extending arm of the training aid.

The Kalmus, U.S. Pat. No. 5,303,944 patent also relates to a bicycle riding training device. However, in this patent, the device is attachable to the bicycle itself and not to the rider. The straps of the instant invention are not disclosed in the Kalmus patent.

The patent to Rubin, U.S. Pat. No. 5,395,130 also relates to a bicycle balance trainer. This device is an attachment to a two wheeled bicycle allowing a teacher to provide a graduated correcting and stabilizing force as indicated in the Abstract. This device comprises two parallel and rigid tubular members which are attached to a bicycle frame and a hairpin shaped handle connected to the tubular members. Again, a strap and rider and the two co-extending straps protruding from the main strap and terminating in a ring or handle is not disclosed in this patent and, therefore, is substantially different.

The patent to Gardenhour, Jr., et al., U.S. Pat. No. 5,217,240 is a device attachable to a tricycle frame for pushing or pulling and does not disclose any of the basic elements of the instant invention.

The patent to Martusciello, U.S. Pat. No. 5,388,551 relates to a harness system worn by a child which includes a waist-encircling band and shoulder straps.

The patent to Brown, et al., U.S. Pat. No. 5,120,287 relates to an infant walking aid. This infant walking aid is adapted to be grasped in one hand of an operator and allows the operator to maintain control. However, in this patent, as best seen in FIGS. 1 and 3, flexible strap members 17 and 18 extend in vertical direction and are joined each to the other at apex section 16 of a harness mechanism defining a lower section of harness mechanism 22.

The patent to Smith, U.S. Pat. No. 4,667,624 is a safety harness for children disclosing a harness that joins a child to a companion by means of an inelastic strap. The strap is joined at one end by a snap hook to one of a plurality of rings spaced along an adult's waist band.

None of the above references teaches or even suggests the use of the unique combination of a wide strap or band fitting around the body of a child learning to ride a bicycle wherein the wide strap or band has two smaller straps or bands attached to it and extending around the back where they are joined into a ring or handle to be grasped by a person assisting the child to learn to ride a bicycle.

SUMMARY OF THE INVENTION

According to the present invention a bike rider balance belt system is provided for assisting in holding and stabilizing a child learning to ride a bicycle and wherein the device allows a teacher or instructor to run or walk along side the bicycle standing substantially straight up rather then bending over to hold the bicycle.

A rather wide belt wraps around the rider's chest and is fastened in the back by way of velcro, buckles, or any other well-known fastening device. The two smaller, narrower, or thin straps are attached co-extensively to the main wide strap or belt, in the back, one on either side, which then extend across the back towards each other and terminate in the middle of the back in a ring or handle which can be grasped by the teacher and which then allows the teacher to hold the rider rather then the bike. If the bike begins to fall, it can be let go while safely holding onto the rider by means of the strap and rings.

It is therefore an object of the present invention to provide a bike rider balance belt.

It is another object of the invention to provide a bike rider balance belt to assist a child in learning to ride a bicycle.

It is a further object of the invention to provide such a bike rider balance belt wherein the invention comprises a rather wide belt which wraps around the rider's chest and fastened in place.

It is still a further object of the invention to provide such a bike rider balance belt further having two smaller or thin straps attached to the main belt, one on each side, and the back, which then extends across the back and terminates in the middle in a ring or handle.

These and further objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

A device to be worn around the upper torso of a novice child bike rider whereby someone assisting the child rider can hold onto the device rather then the bike will now be described with reference to FIGS. 1 - 4 of the drawings.

Figure 2:
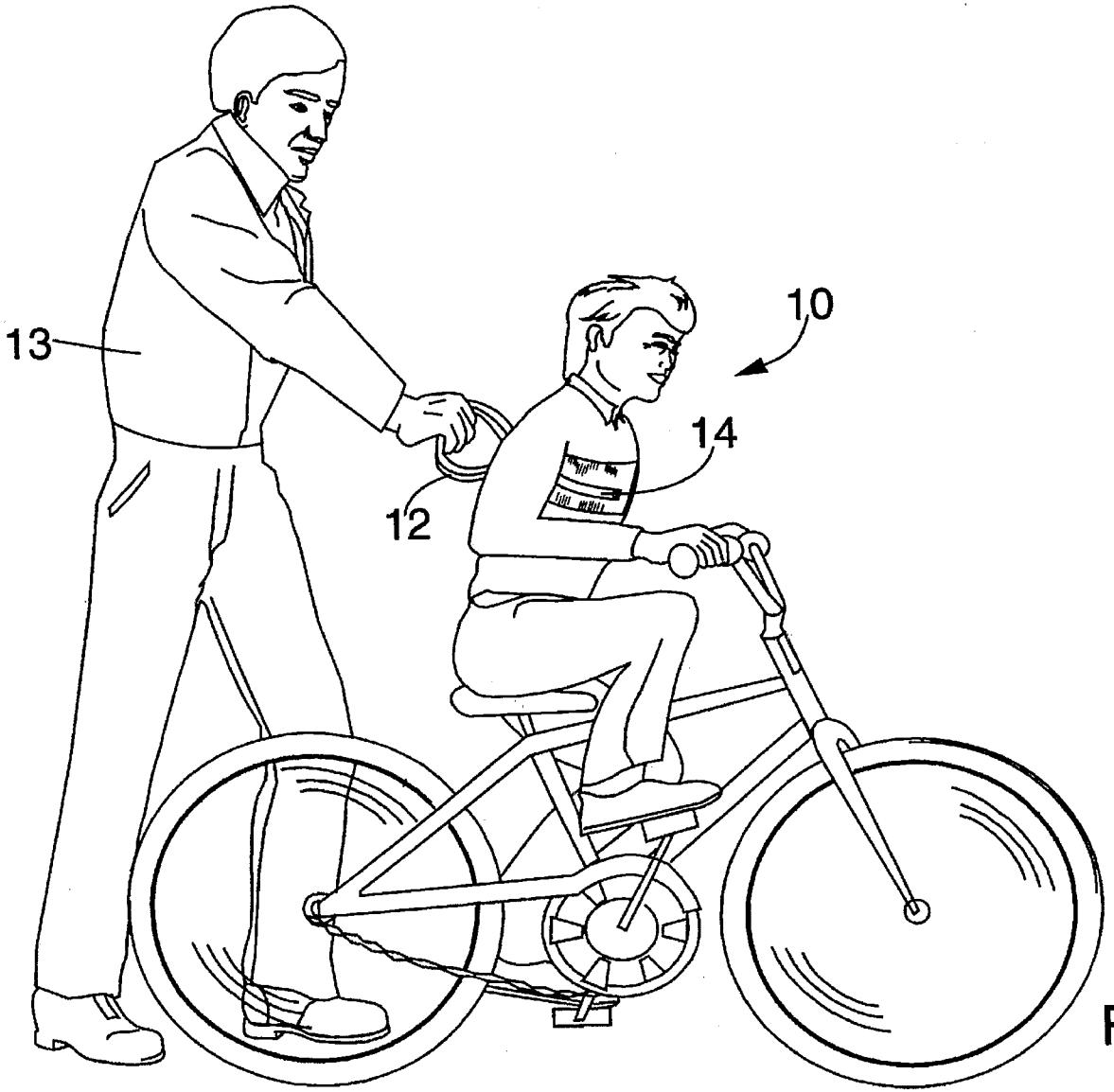
FIG. 2 is a pictorial of the device attached to the upper torso of the child bike rider and disclosing the rings attached to the back of the belt.
Figure 4:
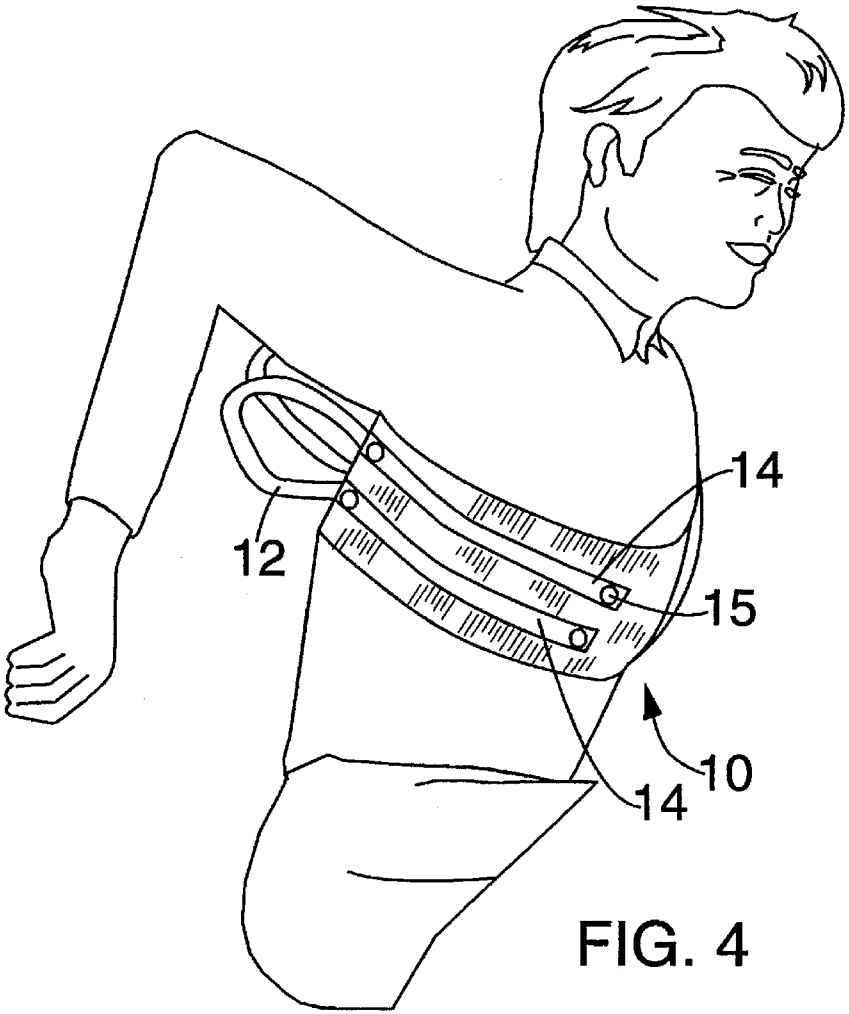
FIG. 4 is similar to FIG. 3 which shows the device closed around the upper torso of the child.
Figure 3:
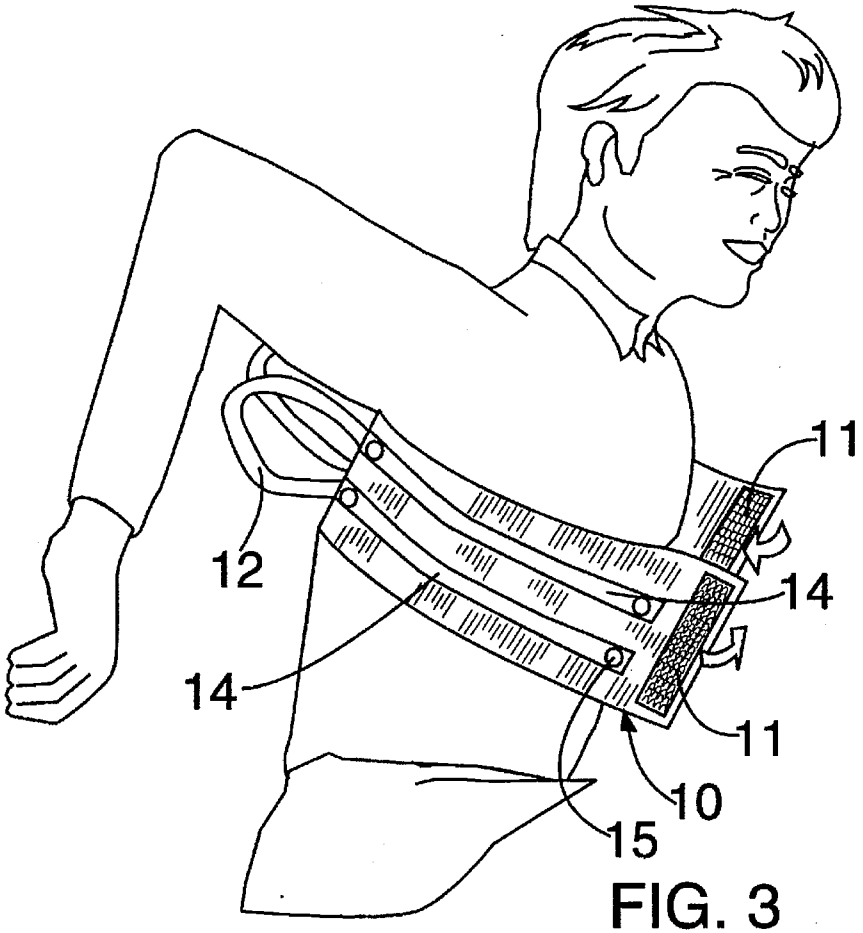
FIG. 3 depicts the device positioned about the upper body torso of the child but not yet closed.

The device itself is shown generally at 10 and is shown wrapped around the upper body portion of the child bike rider in FIGS. 2, 3, and 4.

Figure 1:
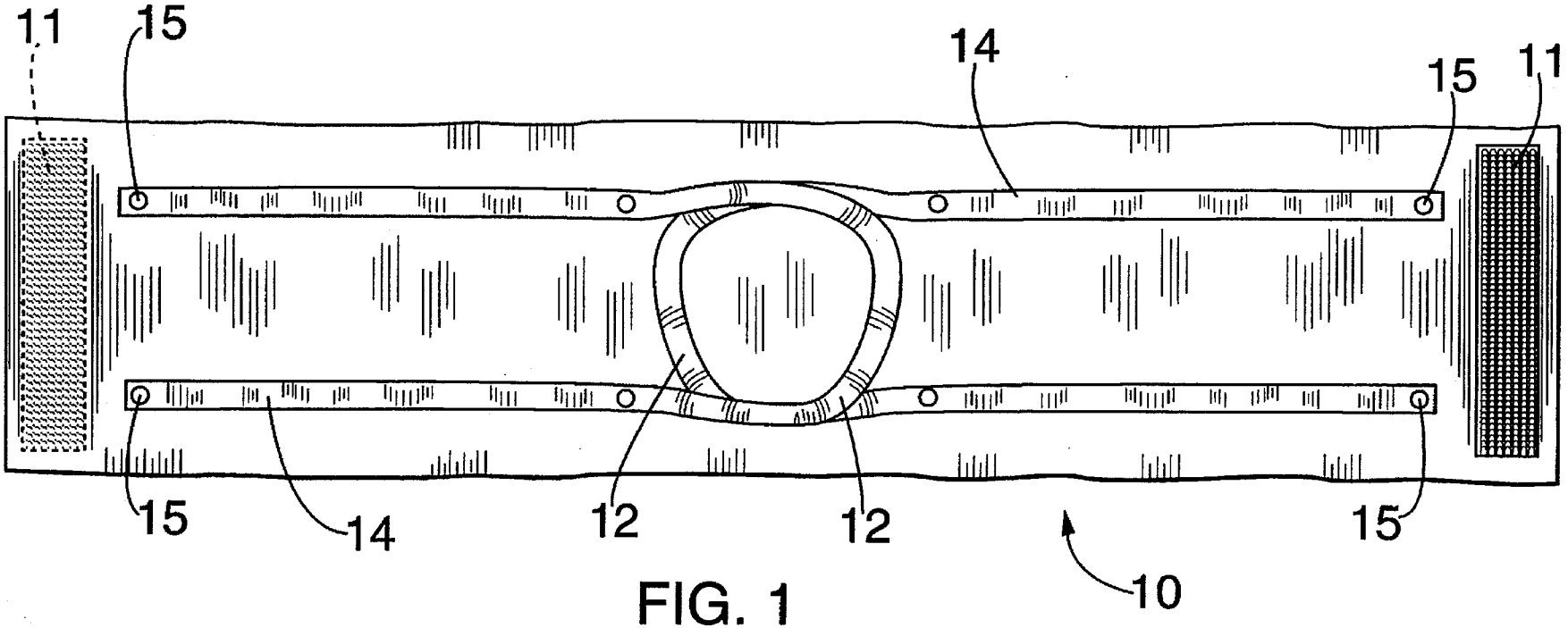
FIG. 1 is a plan view of the device showing the belt, in an open position, velcro material on each end, rings, and straps.

The means for securing the belt around the upper torso of the child bike rider are seen as mating velcro strips 11 attached to the ends of the belt as clearly shown in FIGS. 1 and 3. Although velcro strips are shown in the drawings it is to be understood that any other convenient fastening device such as cooperating buckle parts or buttons and button holes may also be attached to the ends of the belt for safely securing the device around the child.

Attached to the back of the belt are one or more rings 12 to be grasped by an assistant, such as the parent, shown at 13, for holding on to the novice child bike rider rather than stooping or bending to hold the bike itself.

It is important to note that should the bike fall to either side or should the child in any other way lose control, the parent and child can let go of the bike and the child will be safely held by means of the parent grasping the rings 12.

It is quite obvious that one or more rings or, in fact, any other convenient member which can be grasped by an assistant, teacher, or parent can be utilized.

The means disclosed in the drawings for attaching the rings to the belt is a strap or straps 14 which are attached to belt 10 and essentially runs co-extensive and parallel to the belt 10.

It can be seen that straps 14 are attached to the belt 10 at one end by any well-known fastening means such as a rivot 15 or the like. It should be obvious that these ends of the strap or straps can be attached to the belt by snap buttons, sewing, or any other convenient means.

The rings 12 can either form the ring or rings 12 in a loop fashion at the ends of the strap distant from securing means 15 or the rings can be attached to strap or straps 14 in any other convenient and well-known manner.

It should be obvious that one or more straps and therefore one or more rings may be attached to or form a part of the belt that may be grasped by the teacher. It should also be obvious that one or more fastening means such as rivots 15 shown in FIG. 1 may be used to attach the straps to the belt.

In operation, the belt is wrapped around the upper torso of a bike rider with its two ends secured in front by means of any well-known fastening device such as velcro shown in the drawings.

The straps are either formed integrally with the belt or are attached to the belt by any well-known fastening means such as rivots 15.

The other ends of the straps either terminate in a loop which forms a ring or a ring or rings may be attached to this end of the straps.

With the device then in place and the rider on a bicycle, the teacher or assistant or parent can firmly grasp the rings to support and hold the rider. Should control of the bike be lost for any reason it can be let go and the teacher can safely hold the rings.

Though the invention has been described and illustrated with reference to a preferred embodiment thereof, those skilled in the art will appreciate that various changes and modifications in shape, size, composition, and arrangement of parts may be resorted to without departing from the spirit of the invention or scope of the subjoined claims.

What is claimed is:

1. A device worn by a novice child bike rider whereby someone assisting the child rider can hold onto the device rather then the bike comprising:

(a) a belt wrapped around the upper body portion of said child rider;

(b) means for securing said belt to said child bike rider; and (c) means extending from the back of said belt to be grasped by an assistant for holding the child bike rider steady whereby if said bike begins to fall the assistant can hold the device and therefore the child rider rather than the bike wherein said holding means is a loop formed near the middle of said belt when both ends of a strap which runs co-extensive and parallel to said belt and approximately one-half the length thereof are attached to said belt at the same end thereof.

2. The device of claim 1 wherein said means for securing said belt to said child bike rider are strips of velcro material attached to opposite ends of said belt for engaging each other when the ends are folded over each other and around the bike rider.

3. The device of claim 1 wherein said means for securing said belt to said child bike rider are cooperating buckle elements attached to opposite ends of said belt for engaging each other when the ends are folded over each other and around the bike rider.

4. The device of claim 1 wherein said means for securing said belt to said child bike rider are a plurality of buttons attached to one end of said belt and a plurality of mating button holes formed in the other end for engagement when the ends are folded over each other and around the bike rider.

5. A device worn by a novice child bike rider whereby someone assisting the child rider can hold onto the device rather then the bike comprising:

(a) a belt wrapped around the upper body portion of said child rider;

(b) means for securing said belt to said child bike rider; and (c) a plurality of means extending from the back of said belt to be grasped by an assistant for holding the child bike rider steady whereby if said bike begins to fall the assistant can hold the device and therefore the child rider rather than the bike wherein said plurality of means are a plurality of loops formed near the middle of said belt when both ends of a plurality of straps extend co-extensive and parallel to said belt and approximately one-half the length thereof and wherein both ends of each of said plurality of straps are attached to said belt at the same end thereof.

* * * * *